United States Patent [19]

Pangburn

[11] Patent Number: 4,534,138

[45] Date of Patent: Aug. 13, 1985

[54] NAIL FILE HAVING FLEXIBLE ABRASIVE SHEET

[76] Inventor: William E. Pangburn, 2707 Bay Shore, Ventura, Calif. 93003

[21] Appl. No.: 563,151

[22] Filed: Dec. 19, 1983

[51] Int. Cl.[3] ..... B24D 15/00

[52] U.S. Cl. ..... 51/392; 51/370; 51/371; 51/382

[58] Field of Search ..... 51/358, 370, 371, 380, 51/382, 383, 386, 388, 391, 392

[56] References Cited

U.S. PATENT DOCUMENTS

| | | | |
|---|---|---|---|
| 1,927,574 | 9/1933 | Parks | 51/392 X |
| 2,076,973 | 4/1937 | Wilson | 51/370 |
| 2,103,320 | 12/1937 | Corff | 51/382 X |
| 2,575,117 | 11/1951 | Naken | 51/392 |
| 2,595,428 | 5/1952 | Trussell | 51/370 |
| 2,904,939 | 9/1959 | Raia | 51/370 X |
| 4,279,103 | 7/1981 | Rodarte | 51/391 X |

*Primary Examiner*—Robert P. Olszewski

*Attorney, Agent, or Firm*—William W. Haefliger

[57] ABSTRACT

A nail file comprises:

(a) an elongated holder having an elongated handle, (b) a resiliently flexible sheet having an abrasive surface, (c) and clamping structure on the holder retaining the sheet to the handle so that sheet loosely wraps at least partly about the holder with a gap between the sheet of the holder, whereby the sheet wrap when pressed against a fingernail assumes the contour of the fingernail, the sheet wrap being elongated in the direction of the handle.

5 Claims, 4 Drawing Figures

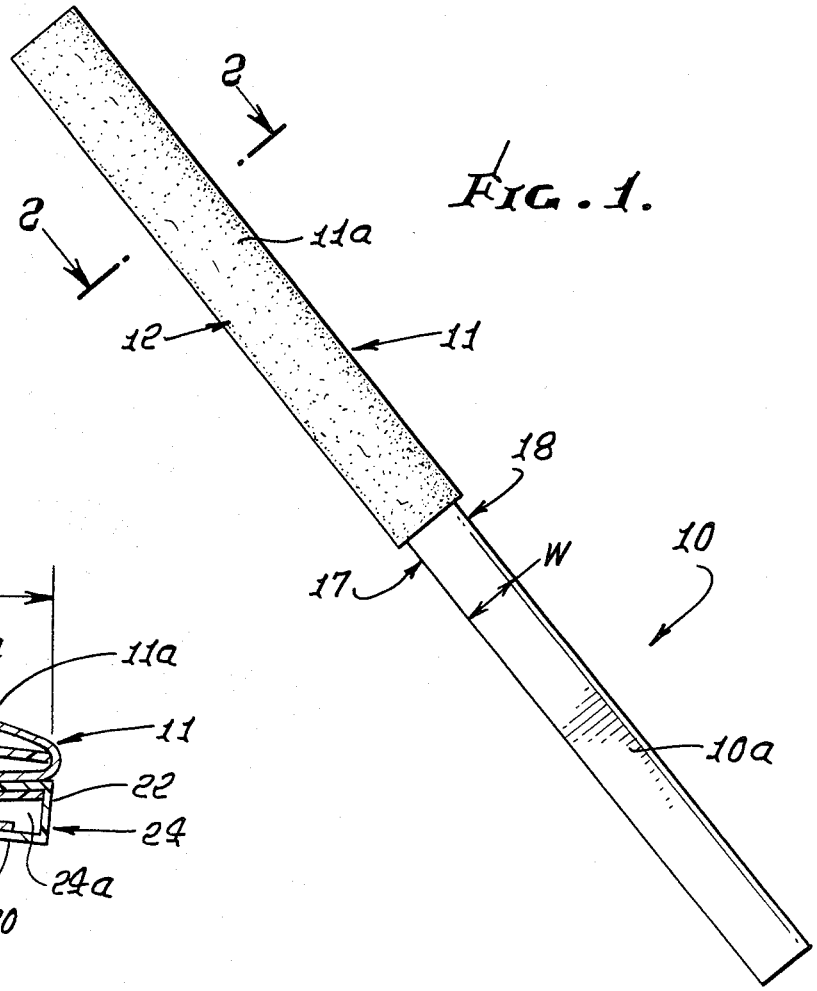
FIG. 1.
FIG. 2.
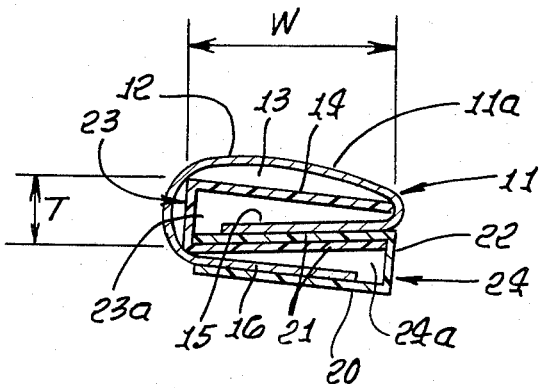
FIG. 3.
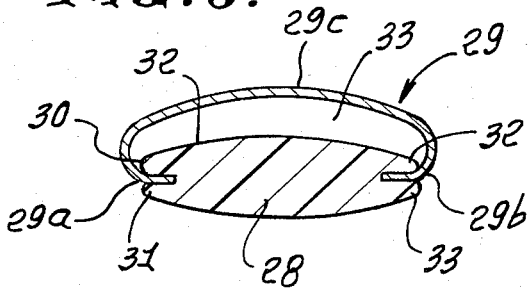
FIG. 4.
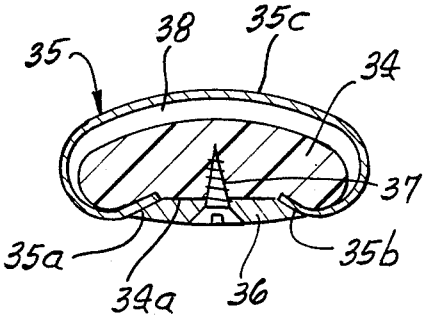

NAIL FILE HAVING FLEXIBLE ABRASIVE SHEET

BACKGROUND OF THE INVENTION

This invention relates generally to apparatus used by manicurists to smooth and buff fingernails. More specifically it concerns a unitary device capable of convenient use to carry out either of these functions, or similar functions.

At the present time and in the past, manicurists accomplished smoothing and buffing of fingernails by using different devices which do not desirably perform to complexly curved nail surfaces; consequently they are difficult to manipulate accurately to buff and smooth such surfaces. Also, such prior devices are difficult to clean. Consequently time and effort were wasted.

SUMMARY OF THE INVENTION

It is a major object of the invention to provide apparatus overcoming the problems referred to above, and also characterized as automatically adjusting to complex nail curvatures.

Basically, the apparatus comprises:

(a) an elongated holder having an elongated handle, (b) a resiliently flexible sheet having an abrasive surface, (c) and structure on the holder retaining the sheet to the handle so that sheet loosely wraps at least partly about the holder with a gap between the sheet and the holder, whereby the sheet wrap when pressed against a fingernail assumes the contour of the fingernail, the sheet wrap being elongated in the direction of the handle.

As will appear, the holder is typically longitudinally elongated, and the sheet has lateral edge portions mechanically retained to widthwise lateral extremities of the holder, along its length, obviating need for adhesives. Further, a uniquely simple holder construction comprises two longitudinally elongated plastic strips having channel shaped cross sections which are intermeshed, the sheet penetrating into the channels defined by said strips for retention therein.

These and other objects and advantages of the invention, as well as the details of an illustrative embodiment, will be more fully understood from the following description and drawings, in which:

DRAWING DESCRIPTION

FIG. 1 is a plan view of a nail file incorporating the invention;

FIG. 2 is a section on lines 2—2 of FIG. 1; and

FIGS. 3 and 4 are sections through modified nail files.

DETAILED DESCRIPTION

In FIGS. 1 and 2, the nail file 10 includes an elongated holder, having a handle portion 10*a* well adapted to be hand held. A second portion 10*b* of the holder carries a resiliently flexible sheet 11 having an outwardly exposed abrasive surface 11*a*. Preferably, the inwardly exposed surface 11*b* is also abrasive to aid in its mechanical retention by the holder, as will be explained. In this regard, structure on the holder retains the sheet 11 to the holder so that the sheet loosely wraps at least partly about the holder (see wrap 12) with a gap 13 between the sheet and the holder surface 14. As a result, when the wrap is pressed aganst a fingernail such as the curved contour of the nail, the wrap easily flexes resiliently toward surface 14 and gap 13, and locally assumes the contour of the local portion of the nail being buffed or smoothed; and the wrap resiliently returns to or resumes its outwardly convex contour as seen in FIG. 2, when removed from the nail. Note that the wrap is elongated in the direction of handle 10*a*.

More specifically, the holder is longitudinally elongated and typically has lateral width "w" greater than its thickness T, the sheet wrap 12 extending loosely across the width dimension of the holder.

It is a feature of the invention that the sheet 11 is mechanically retained to the holder, to obviate problems of adhering it to the holder by means of adhesives, etc., which are difficult to effectively employ in the case of abrasive sheets. For this purpose, retaining structure is provided to mechanically retain the sheet to lateral extremities of the holder. To this end, sheet edge portions typically penetrate into the holder. Note in the regard, sheet edge portions 15 and 16 penetrating into the holder in FIG. 2, whereby, the sheet is mechanically retained to lateral edge portions 17 and 18 of the holder.

In the specific example of FIG. 2, which is very effective and quick and easy to assemble, enabling ease of cleaning of the abrasive sheet and removal and replacement of same, the holder comprises two, like, longitudinally elongated molded plastic strips having channel shaped cross sections, each with two flanges 20 and 21 interconnected by a web 22. The flanges project relatively toward one another, and the abrasive sheet engages the inner sides of the flanges and is frictionally retained thereto. Further, the strips are intermeshed, with the two flanges 21 extending laterally oppositely and side by side, as shown. The sheet edge portion 15 extends into channel 23*a* between flanges 20 and 21 of one strip 23, to frictionally engage such flanges, and the sheet edge portion 16 extends into the channel 24*a* between flanges 20 and 21 of the other strip 24, to frictionally engage such flanges. Accordingly, the sheet edge portions are retained in position, and the two strips are held together, in intermeshed relation, all parts cooperating in unusually effective manner to provide the effective nail file apparatus, whereas before their unique assembly in this manner, the parts consist of two separate and non-related plastic channels, and one flat sheet with surface abrasive material.

FIG. 3 shows another configuration with a single piece handle 28, and a sheet 29 (like sheet 11) having edge portions 29*a* and 29*b* mechanically retained (as by pinch effect) between jaws 30 and 31, and 32 and 33. Note sheet wrap 29*c* extending widthwise across the handle curved surface 32, and spaced therefrom as via gap 33.

FIG. 4 shows yet another configuration with a single piece handle 34, and a sheet 35 (like sheet 11) having edge portions 35*a* and 35*b* mechanically held in position (as by pinch effect) between the under concave surface 34*a* of the handle, and the filler piece 36 fitting in the cavity formed by surface 34*c*. Filler piece 36 may be retained in position as by fastener 37 extending into the handle 34. Sheet 35 wraps at 35*c* across the handle, with a gap 38 therebetween, for purposes as described above.

The sheets 11, 29 and 35 may have the composition as described in my pending application Ser. No. 407,738, filed Aug. 13, 1982. As therein disclosed, the sheet consists of a tough, silicone polymer carrying abrasive particles protruding from one or both sides of the sheet, the particulate advantageously consisting of pumice. Other sheet materials are also usable.

I claim:

1. In a nail file, the combination comprising (a) an elongated holder having an elongated handle, (b) a resiliently flexible sheet having an abrasive surface, (c) and structure on the holder retaining the sheet to the handle so that sheet loosely wraps at least partly about the holder with a gap between the sheet and the holder, whereby the sheet wrap when pressed against a fingernail assumes the contour of the fingernail, the sheet wrap being elongated in the direction of the handle, (d) the holder comprising two longitudinally elongated plastic strips having channel shaped cross sections which are intermeshed, opposed ends of the sheet penetrating into the channels defined by said strips for retention therein, such that one of said opposed ends of the sheet is retained by one of said channels and the other of said opposed ends is retainer in the other of said channels, (e) said sheet also wrapping over the outwardly facing surface of one of the channels, the outwardly facing surface of the other channel remaining exposed to the exterior.

2. The combination of claim 1 wherein said holder is longitudinally elongated and has lateral width greater than its thickness.

3. The combination of claim 2 wherein said sheet retaining structure retains the sheet to lateral extremities of the holder.

4. The combination of claim 1 wherein said sheet consists of silicone polymer carrying abrasive particulate exposed at at least one side of the sheet.

5. The combination of claim 4 wherein said particulate consists of pumice.

* * * * *